US008719033B2

(12) United States Patent
Lien et al.

(10) Patent No.: US 8,719,033 B2
(45) Date of Patent: May 6, 2014

(54) GREETING CARD HAVING KARAOKE RECORD FEATURE AND SIMULTANEOUS PLAYBACK

(75) Inventors: Timothy J. Lien, Lenexa, KS (US); Randy S. Knipp, Kansas City, MO (US); Robert D. Wertanen, Parkville, MO (US); Sara F. Coash, Kansas City, KS (US); Elizabeth A. Fine, Lawrence, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 284 days.

(21) Appl. No.: 12/847,780

(22) Filed: Jul. 30, 2010

(65) Prior Publication Data

US 2010/0307036 A1 Dec. 9, 2010

Related U.S. Application Data

(63) Continuation-in-part of application No. 12/101,789, filed on Apr. 11, 2008.

(51) Int. Cl.
*G10L 21/00* (2013.01)

(52) U.S. Cl.
USPC ..... 704/272; 704/270; 40/717; 40/124.03; 340/686.1; 434/319

(58) Field of Classification Search
USPC ..... 40/717, 124.03; 434/319; 340/686.1; 704/270
See application file for complete search history.

(56) References Cited

U.S. PATENT DOCUMENTS

| | | | |
|---|---|---|---|
| 3,798,806 | A | 3/1974 | Sanford |
| 4,611,262 | A | 9/1986 | Galloway |
| 4,677,657 | A | 6/1987 | Nagata et al. |

(Continued)

FOREIGN PATENT DOCUMENTS

| | | |
|---|---|---|
| CA | 1278862 | 1/1991 |
| DE | 3532259 | 10/1985 |

OTHER PUBLICATIONS

Land'S End—Recordable Gift Card Carrier, at least as early as Jun. 27, 2007.
Winbond—Information Manual for ISD18B12—Aug. 17, 2007.

*Primary Examiner* — Michael Colucci
(74) *Attorney, Agent, or Firm* — Shook, Hardy & Bacon L.L.P.

(57) ABSTRACT

A greeting card having an audio recording and playback device permits recording of a karaoke-style song to be played upon opening of the greeting card. A user sings along with a permanently prerecorded, karaoke-style song that is played during a recording session. The recording device is operable in either a trial mode or a use mode. In the trial mode, a user-recorded song is played back initially for the potential purchaser but is not subsequently played back to be later heard by other potential purchasers. In the use mode, which the card may be switched to after purchase by removal of a trial mode panel from the greeting card, a user-recorded karaoke-style song is played upon subsequent openings of the card. During playback, the user-recorded song is played simultaneously with the prerecorded karaoke-style recording that was played during the recording session. Additional prerecorded messages, such as voice prompts with instructions, may also be included. The audio recording and playback device may also be included in other non-greeting card products, such as a plush toy and an ornament.

18 Claims, 9 Drawing Sheets

(56) References Cited

U.S. PATENT DOCUMENTS

| | | | | | |
|---|---|---|---|---|---|
| 4,791,741 | A | * | 12/1988 | Kondo | 704/272 |
| 5,045,327 | A | * | 9/1991 | Tarlow et al. | 704/270 |
| 5,063,698 | A | * | 11/1991 | Johnson et al. | 40/124.03 |
| 5,232,087 | A | * | 8/1993 | Schluger | 206/45.29 |
| 5,251,251 | A | | 10/1993 | Barber | |
| 5,387,108 | A | * | 2/1995 | Crowell | 434/319 |
| 5,425,078 | A | * | 6/1995 | Stern | 379/88.23 |
| 5,444,767 | A | | 8/1995 | Goetcheus et al. | |
| 5,502,463 | A | * | 3/1996 | Sasaki et al. | 345/204 |
| 5,513,117 | A | | 4/1996 | Small | |
| 5,652,606 | A | | 7/1997 | Sasaki et al. | |
| 5,719,920 | A | * | 2/1998 | Harman | 379/88.07 |
| 5,812,899 | A | * | 9/1998 | McIntyre | 396/661 |
| 5,860,065 | A | * | 1/1999 | Hsu | 704/270 |
| 6,028,752 | A | | 2/2000 | Chomette et al. | |
| 6,030,274 | A | * | 2/2000 | Kaplan | 446/369 |
| 6,104,306 | A | * | 8/2000 | Hogue et al. | 340/686.1 |
| 6,158,588 | A | | 12/2000 | Conti | |
| 6,253,183 | B1 | | 6/2001 | Boucard | |
| 6,282,819 | B1 | | 9/2001 | Gu | |
| 6,288,319 | B1 | * | 9/2001 | Catona | 84/609 |
| 6,441,921 | B1 | | 8/2002 | Soscia | |
| 6,453,300 | B2 | | 9/2002 | Simpson | |
| 6,608,972 | B1 | | 8/2003 | Lemelson et al. | |
| 6,816,679 | B2 | | 11/2004 | Lemelson et al. | |
| 6,845,583 | B2 | * | 1/2005 | Lee | 40/717 |
| 7,127,841 | B1 | | 10/2006 | Weber | |
| 7,152,350 | B2 | | 12/2006 | Youngdahl | |
| 7,205,473 | B2 | | 4/2007 | Li et al. | |
| 7,356,154 | B1 | | 4/2008 | Kotzin | |
| 7,356,950 | B1 | * | 4/2008 | Avery | 40/124.02 |
| 7,603,802 | B2 | | 10/2009 | Oudekerk | |
| 8,312,652 | B2 | | 11/2012 | Mayer et al. | |
| 2002/0105185 | A1 | | 8/2002 | Cobb | |
| 2002/0139017 | A1 | * | 10/2002 | Pines | 40/124.03 |
| 2003/0064353 | A1 | * | 4/2003 | Clapper | 434/319 |
| 2003/0156686 | A1 | * | 8/2003 | Pines | 379/67.1 |
| 2003/0182827 | A1 | * | 10/2003 | Youngdahl | 40/124.06 |
| 2004/0139318 | A1 | | 7/2004 | Fiala | |
| 2004/0204135 | A1 | | 10/2004 | Zhao | |
| 2005/0102867 | A1 | * | 5/2005 | Youngdahl | 40/124.11 |
| 2006/0075033 | A1 | | 4/2006 | Bienstock | |
| 2006/0134591 | A1 | * | 6/2006 | Karat | 434/308 |
| 2007/0082711 | A1 | | 4/2007 | Zhao | |
| 2007/0150082 | A1 | * | 6/2007 | Yang et al. | 700/94 |
| 2007/0171278 | A1 | | 7/2007 | Chen | |
| 2007/0238082 | A1 | | 10/2007 | Ingrassia | |
| 2007/0256337 | A1 | | 11/2007 | Segan | |
| 2007/0284269 | A1 | | 12/2007 | Star | |
| 2008/0016731 | A1 | * | 1/2008 | Branch | 40/124.03 |
| 2008/0275706 | A1 | * | 11/2008 | Paulini | 704/272 |
| 2009/0126239 | A1 | * | 5/2009 | Clegg | 40/124.03 |
| 2009/0132242 | A1 | * | 5/2009 | Wang et al. | 704/216 |
| 2009/0161839 | A1 | | 6/2009 | Neumann | |
| 2009/0281794 | A1 | | 11/2009 | Ben-Haroush | |
| 2010/0050486 | A1 | | 3/2010 | Clegg | |
| 2010/0052876 | A1 | | 3/2010 | Clegg | |
| 2010/0052934 | A1 | | 3/2010 | Clegg | |

* cited by examiner

GREETING CARD HAVING KARAOKE RECORD FEATURE AND SIMULTANEOUS PLAYBACK

CROSS-REFERENCE TO RELATED APPLICATIONS

This application is a continuation-in-part of pending U.S. nonprovisional application Ser. No. 12/101,789, entitled "Greeting Card Having Audio Recording Capabilities with Trail Mode Feature," filed Apr. 11, 2008, U.S. Publication No. 2009/0259474, which is hereby expressly incorporated by reference in its entirety.

STATEMENT REGARDING FEDERALLY SPONSORED RESEARCH OR DEVELOPMENT

Not Applicable

BRIEF SUMMARY OF THE INVENTION

The present invention relates to a greeting card with an audio recording and playback component. More particularly, this invention relates to a greeting card having a user recordable component that permits a giver of the greeting card to record a karaoke-style version of a song to customize the greeting card prior to delivery to its intended recipient. During playback of the user-recorded karaoke-style song, the greeting card simultaneously plays both the user-recorded audio recording and the permanently prerecorded song on the greeting card. In one embodiment, the user recordable component includes a trial mode that permits potential consumers to try out the audio recording and playback component in a store where the greeting card is on display prior to purchase.

Paper greeting cards that play prerecorded songs upon opening of the card have become well received by consumers. In an effort to provide consumers with the ability to personalize and customize a sound card prior to its delivery to the intended recipient with more than personal written sentiment, the present invention permits users to record their own karaoke-style version of a song on the greeting card that will be played upon opening of the card by the intended recipient. In one embodiment, the greeting card is already provided with a non-user recorded, prerecorded and permanent recording, such as a song without words (i.e. an instrumental). The user is then permitted to "sing along" with the prerecorded song in order to record the user's own karaoke-style version of the song on the card, which is then played upon opening of the card. For example, during a user recording session, the prerecorded song on the card is played while the user is recording the user-recorded version of the song. During playback, the audio recording and playback component simultaneously plays back the non-user recorded song along with the user-recorded version. In some instances, the user could further customize the greeting card by making up the user's own lyrics to the prerecorded song.

In another embodiment, the card is provided with a first prerecorded audio file that includes audible instructions to assist a user of the card with the process of recording of their own karaoke-style song. This instruction recording is played upon opening of the card when the card is in a trial mode. The trial mode permits a potential purchaser to sample the functionality of the greeting card by recording their own test song. The recorded test song is then automatically played back upon completion of the recording session. To avoid having greeting cards that play karaoke-style songs recorded by previous shoppers and left for future potential purchasers to hear, the trial mode of the greeting card does not provide a manner by which a user-recorded song may be played back a second time subsequent to the automatic playback.

The greeting card also includes a use mode where a purchaser of the card may permanently record a karaoke-style song that can be subsequently played back at a later time. To provide this feature, the card is provided with a removable portion that switches the card from the trial mode to the use mode. This feature is disclosed in pending U.S. Nonprovisional application Ser. No. 12/101,789, filed Apr. 11, 2008, which is hereby incorporated by reference in its entirety.

Further objects, features and advantages of the present invention over the prior art will become apparent from the detailed description of the drawings which follows, when considered with the attached figures.

BRIEF DESCRIPTION OF THE SEVERAL VIEWS OF THE DRAWING

The features of the invention noted above are explained in more detail with reference to the embodiments illustrated in the attached drawing figures, in which like reference numerals denote like elements, in which FIGS. 1-11 illustrate several possible embodiments of the present invention, and in which:

FIG. 1 is a perspective view of an interior of a partially opened greeting card constructed in accordance with an embodiment of the present invention;

FIG. 2 is a side elevation view of the interior of the greeting card of FIG. 1 with the greeting card in the fully open position;

FIG. 3 is a side elevation view of the interior of the greeting card of FIG. 2 with a trial flap moved to the left and certain internal components of the greeting card illustrated in dashed lines;

FIG. 4 is a side elevation view of the interior of the greeting card of FIG. 3 with a majority of the interior front and back cover panels cut-away to reveal electrical components of the greeting card;

FIG. 5 is a perspective view of the back of the partially opened greeting card of FIG. 1 with a power supply opening on the back panel of the card body;

FIG. 6 is a front side elevation view of a plush toy constructed in accordance with an alternate embodiment of the present invention;

FIG. 7 is a rear side elevation view of the plush toy of FIG. 6;

FIG. 8 is perspective view of another plush toy constructed in accordance with yet another alternate embodiment of the present invention;

FIG. 9 is a front side elevation view of an ornament constructed in accordance with still another alternate embodiment of the present invention;

FIG. 10 is a rear side elevation view of the ornament of FIG. 9; and

FIG. 11 is a right side elevation view of the ornament of FIG. 9.

DETAILED DESCRIPTION OF THE INVENTION

Figure 1:
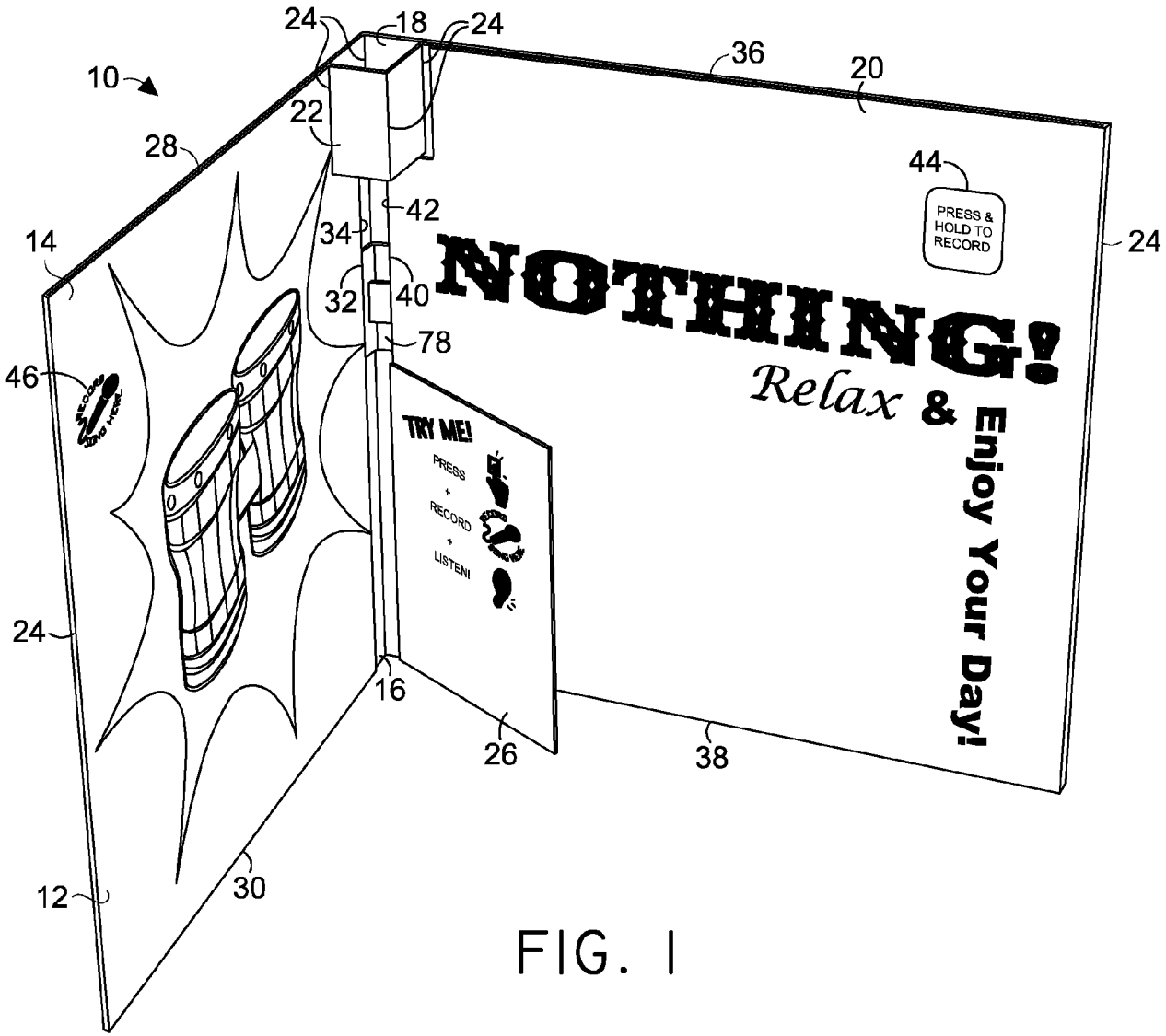

Referring now to the drawings in more detail and initially to FIG. 1, numeral 10 generally designates a greeting card constructed in accordance with an embodiment of the present invention. The greeting card 10 includes a card body 12. In the illustrated embodiment, the card body 12 includes an interior front cover panel 14, a front panel 16, a back panel 18, and an interior back cover panel 20. As readily understood by one of ordinary skill in the art, the card body 12 may consist of a single piece of card stock that has been folded along fold lines 24 to provide four panels, namely panels 14, 16, 18, and 20, as depicted in the illustrated embodiment. It would also be readily understood that the panels 14, 16, 18, and 20 may be individual panels that are joined to one another using any number of methods known in the art, and that the card body 12 could have any number of panels.

Figure 2:
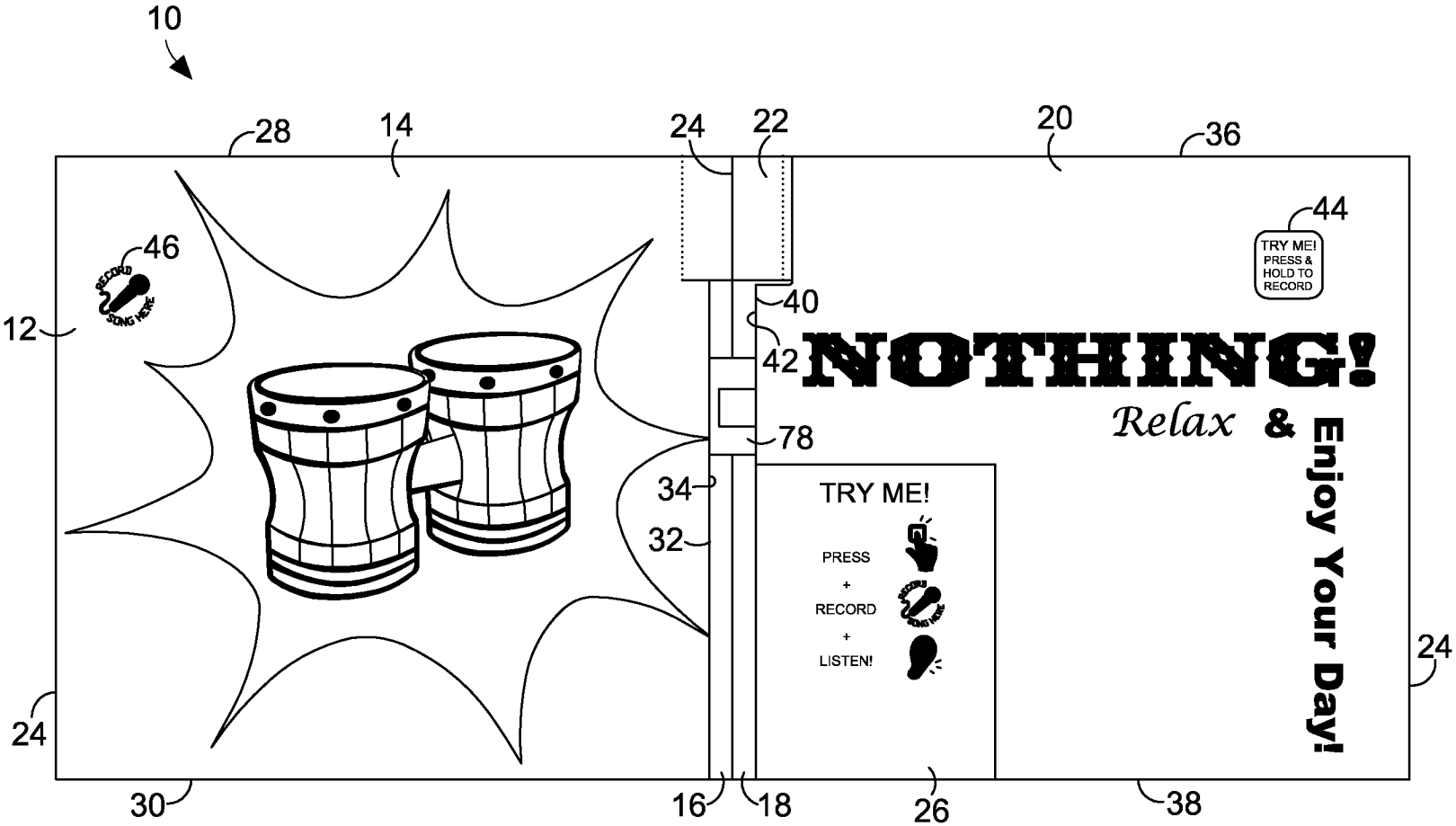

The card body 12 also includes a joint flap 22. In the illustrated embodiment, the joint flap 22 extends from and is connected to the interior front cover panel 14 of the card body 12 by a fold line. Additionally, a distal portion of the joint flap 22 is attached between the back panel 18 and the interior back cover panel 20. When the greeting card 10 is in an open position, as depicted in FIG. 2, the joint flap 22 is in contact with (flattened against) the front panel 16 and the back panel 18. The joint flap 22 is folded in the middle so that when the greeting card 10 is in a closed position, the center fold line 24 of the joint flap 22 projects inward and is no longer in contact with the front panel 16 and the back panel 18. As will be understood, the joint flap 22 may be a part of a single piece of card stock that is used to provide panels 14, 16, 18, and 20, as illustrated. Alternatively, the joint flap 22 may be an individual flap panel joined to the other panels of the card body 12 using any number of methods known in the art.

Figure 3:
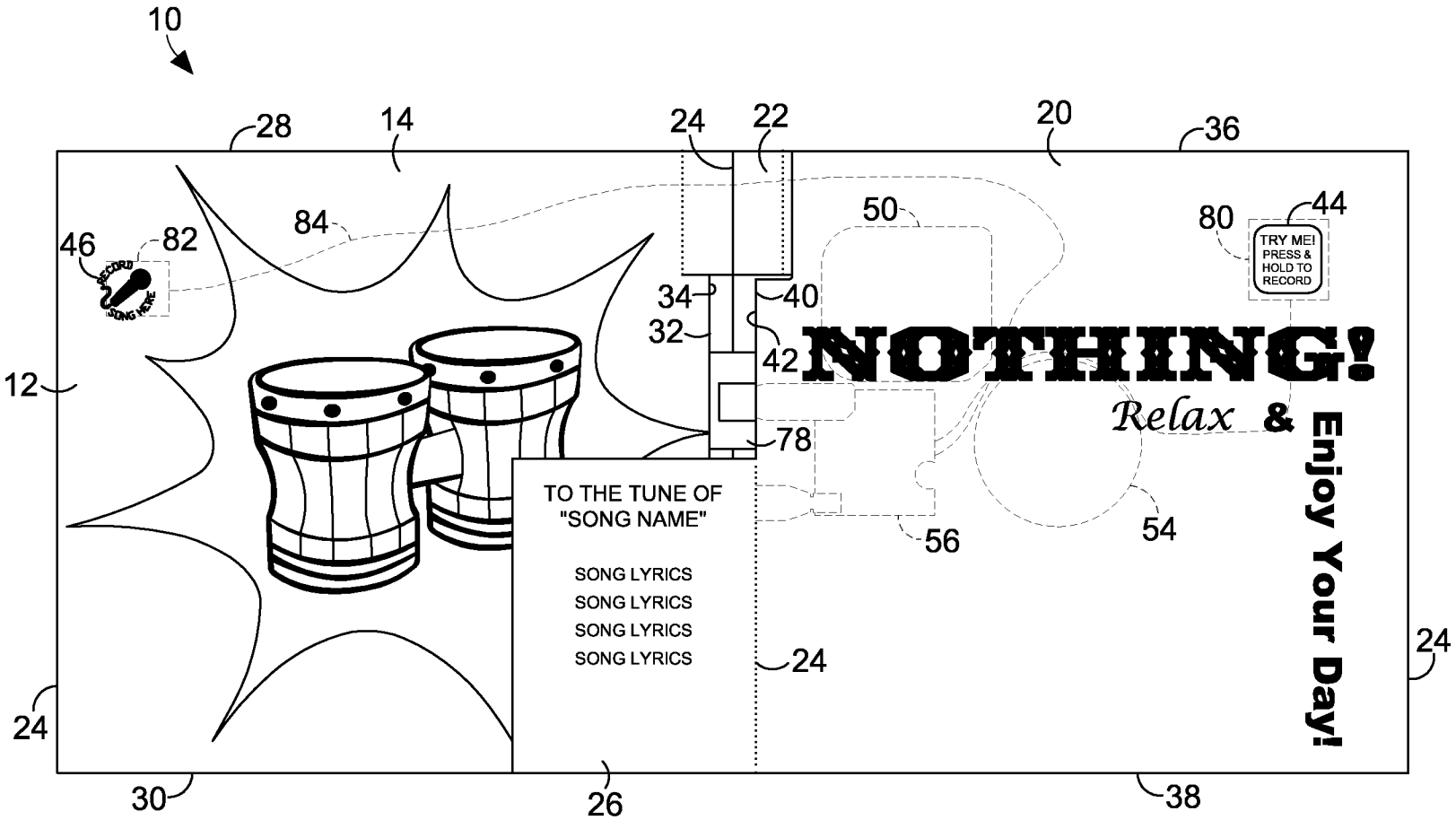

A trial mode panel or flap 26 may also be provided and is preferably coupled with the card body 12. In the illustrated embodiment, the trial mode panel 26 extends from and is connected to the interior back cover panel 20 by a fold line 24 and is a part of and is cut out with the card blank that forms the card body 12. The fold line 24 between the trial mode panel 26 and the interior back cover panel 20 is scored to provide a perforated tear line that facilitates removal of the trial mode panel 26, as discussed below. In one embodiment, instructions are printed on the front side of the trial mode panel 26, as shown in FIG. 2, and song lyrics are printed on the back side, as shown in FIG. 3.

FIG. 2 also illustrates a record label 44 preferably located on the interior back cover panel 20, and a microphone label 46 preferably located on the interior front cover panel 14. The record label 44 indicates to a user where to press and hold to initiate a recording session using an audio recording and playback device 48 coupled with the greeting card 10. Similarly, the microphone label 46 is provided to indicate to a user where to direct the user's voice when the user is recording their voice to generate a karaoke-style audio recording using the audio recording and playback device 48. As will be understood, the record label 44 and the microphone label 46 may be located on any portion of the card body 12. In one embodiment, components of the audio recording and playback device 48 are associated with the record label 44 and the microphone label 46. For example, a first switch 80 is located between the back panel 18 and the interior back cover panel 20, and beneath the record label 44. Similarly, a microphone 82 is located between the front panel 16 and the interior front cover panel 14, and beneath the microphone label 46. It is to be understood that, while the record label 44 and the microphone label 46 have been described as labels which could be peeled off the greeting card 10, either label could be omitted and the information from the label be directly printed directly on the card body 12.

In the illustrated embodiment, the card body 12 has been folded such that the interior front cover panel 14 overlies the front panel 16. The interior front cover panel 14 and the front panel 16 have been secured together along a front upper edge 28 of the card body 12 and a front lower edge 30 of the card body 12. A front unsecured edge 32 of the card body 12 has been left unsecured to the front panel 16. As such, the interior front cover panel 14 and the front panel 16 define a first pocket or cavity 34 into which components of an audio recording and playback device 48 may be positioned.

Additionally, the card body 12 has been folded such that the interior back cover panel 20 overlies the back panel 18. The interior back cover panel 20 and the back panel 18 have been secured together along a back upper edge 36 of the card body 12 and along a back lower edge 38 of the card body 12. A back unsecured edge 40 of the card body 12 has been left unsecured to the back panel 18. As such, the interior back cover panel 20 and the back panel 18 define a second pocket or cavity 42 into which components of the audio recording and playback device 48 may be positioned.

As shown in FIG. 3, a certain number of internal components of the greeting card 10 are illustrated with dashed lines. The microphone 82 is shown inside the first pocket 34 of the card body 12. A power supply 50, a speaker 54, a circuit board 56 and a first switch 80 are shown inside the second pocket 42 of the card body 12. The song lyrics, printed on the back side of the trial mode panel 26, correspond to a prerecorded audio recording permanently recorded on the audio recording and playback device 48 of the greeting card 10.

Figure 4:
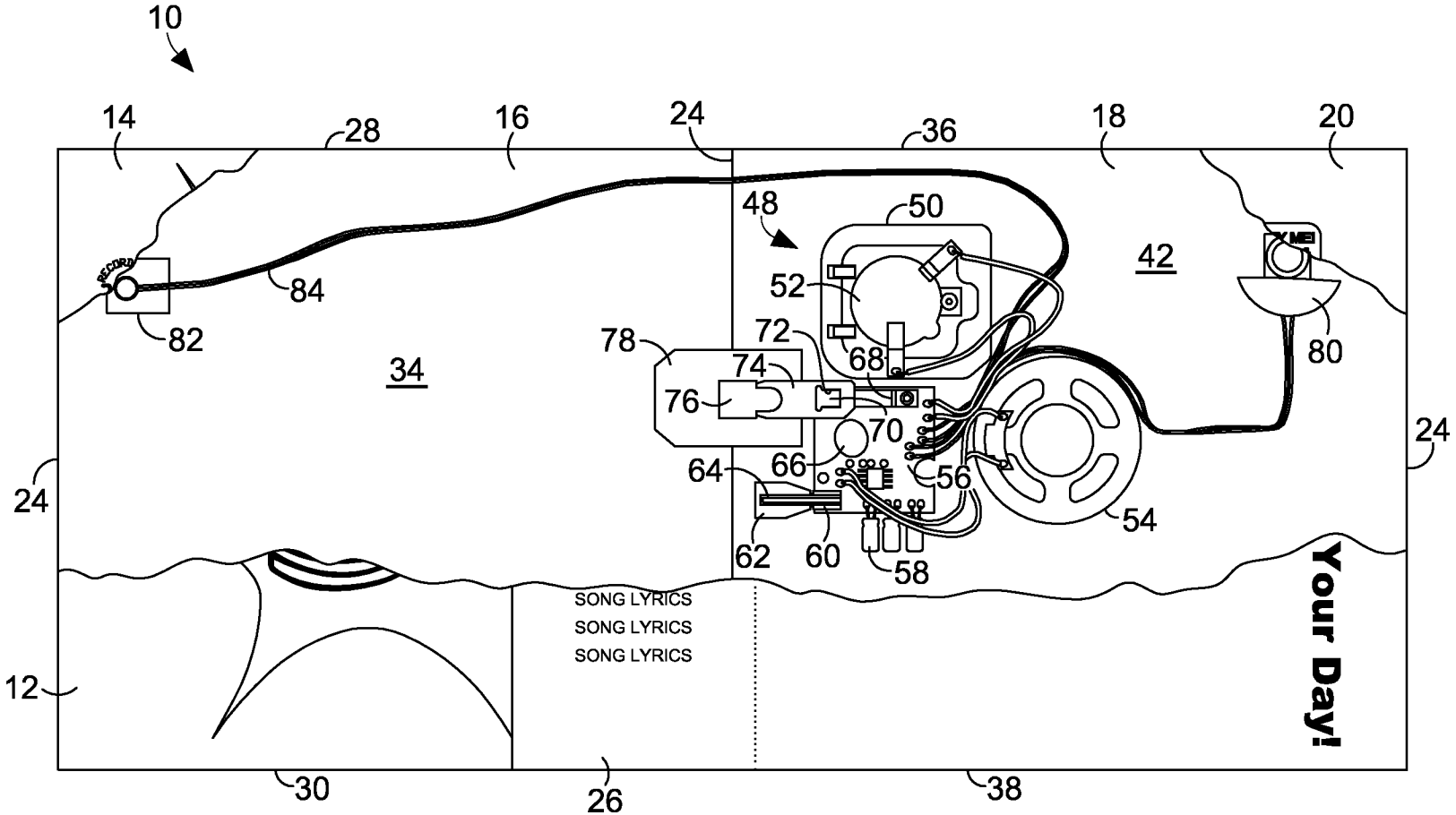

Turning now to FIG. 4, the audio recording and playback device 48 is illustrated. Components of the audio device 48, for ease of manufacture and assembly of the greeting card 10, may be provided on a carrier (not shown) that is adhered to inner surfaces of the front and back panels 16 and 18. Alternatively, as shown in the illustrated embodiment, components of the audio device 48 may be individually positioned inside one or both of the first pocket 34 and the second pocket 42.

The audio device 48 preferably includes the power supply 50 with a battery 52, the speaker 54, the circuit board 56, an integrated circuit 66, and first, second, and third switches 80, 68, and 60. The audio device 48 may also include a separate memory chip (not shown) for storing the prerecorded audio recording and/or the user recorded karaoke-style audio recording. In addition to the electrical components mentioned, which are mechanically and/or electrically coupled with the circuit board 56, other electrical components 58 may be coupled with the circuit board 56, as would be readily understood and appreciated by one of skill in the art.

In the illustrated embodiment, the audio device 48 includes a separate speaker 54 and microphone 82. While combination microphone/speaker devices exist, by physically spacing apart the speaker 54 and the microphone 82, the audio device 48 is capable of recording a user's vocals or audio recording into the microphone 82 with minimal interference from or pick up of the prerecorded audio recording, or song, that is playing simultaneously out of the speaker 54 during an audio recording session. This way, the user recorded audio file contains as little of the prerecorded audio recording as background noise as possible, for reasons discussed below. As illustrated, wiring 84, used to couple the microphone 82 to the circuit board 56, is strategically placed along the back upper edge 36 and the front upper edge 28, such that the microphone wiring 84 is concealed behind the joint flap 22. It is understood that the joint flap 22 could be omitted and the wiring 84 left exposed or be concealed in other manners.

It is also to be understood that, in other embodiments, the microphone wiring 84 may be located on different portions of the card body 12. Additionally, two separate devices could be replaced by one combination device and still be within the scope of the present invention. Similarly, in the illustrated embodiment, the power supply 50 is provided by a battery 52. Other methods of powering the audio device 48 are known and within the scope of the present invention. Further still, while the audio device 48 is illustrated as only including a single integrated circuit 66, it could be replaced by more than one integrated circuit.

The first switch 80 is configured to provide the audio device 48 with activation of its recording feature. Accordingly, in the illustrated embodiment, the first switch 80 is implemented as a record button 80. As would be understood by one of ordinary skill in the art, the pressing of the recorded button 80 initiates a recording session whereby a user may record their own audio to the audio device 48 by way of the microphone 82. In the illustrated configuration, the recording sessions lasts as long as the record button 80 is depressed or until the capacity of the memory of the audio device 48 is reached.

The second switch 68, in the illustrated embodiment, has been implemented as a slide switch 68. The slide switch includes a contact arm 70 which is biased into engagement with a contact surface (not shown) on the circuit board 56. The slide switch 68 also includes a slide tab 74 that is movable between the first position partially illustrated in FIG. 1, where a portion of the slide tab 74 is intermediate the contact arm 70 and the contact surface of the circuit board 56, thereby creating an open circuit, and the second position illustrated in FIG. 4, where the greeting card 10 is in an open position and an aperture 72 in the slide tab 74 permits the contact arm 70 to abut the contact surface of the circuit board 56, thereby creating a closed circuit. A proximal end 76 of the slide tab 74 may be positioned over the inner surface of the front panel 16 using tab adhesive 78, whereby movement of the front panel 16 away from the interior back cover panel 20 (i.e., opening the card) pulls the slide tab 74 out from between the contact arm 70 and the contact surface of the circuit board 56 and whereby subsequent closing of the greeting card 10 (i.e., moving the front panel 16 towards the interior back cover panel 20) moves the slide tab 74 back between the contact arm 70 and the contact surface of the circuit board 56.

In the illustrated embodiment, the third switch 60 is implemented as a tear switch 60. The tear switch 60 includes a strip 62 having a path 64 thereon. A portion of the strip 62 is coupled with the trial mode panel 26 and another portion of the strip is coupled with the circuit board 56. In the embodiment illustrated in FIG. 4, where the strip 62 is still one piece, electricity may flow from the circuit board 56 through the path 64 and return back to the circuit board 56, thereby informing the audio device 48 that the trial mode panel 26 is still in place and that the audio device 48 should function in its trial mode. When the trial mode panel 26 is detached from the greeting card 10, as disclosed in U.S. Nonprovisional application Ser. No. 12/101,789 that is incorporated herein, the strip 62 is torn into two pieces and the path 64 is broken. As a result, the tear switch 60 is moved from a closed circuit to an open circuit, the change in the state of the tear switch 60 is recognized by the audio device 48, and the audio device 48 functions in a use mode.

Figure 5:
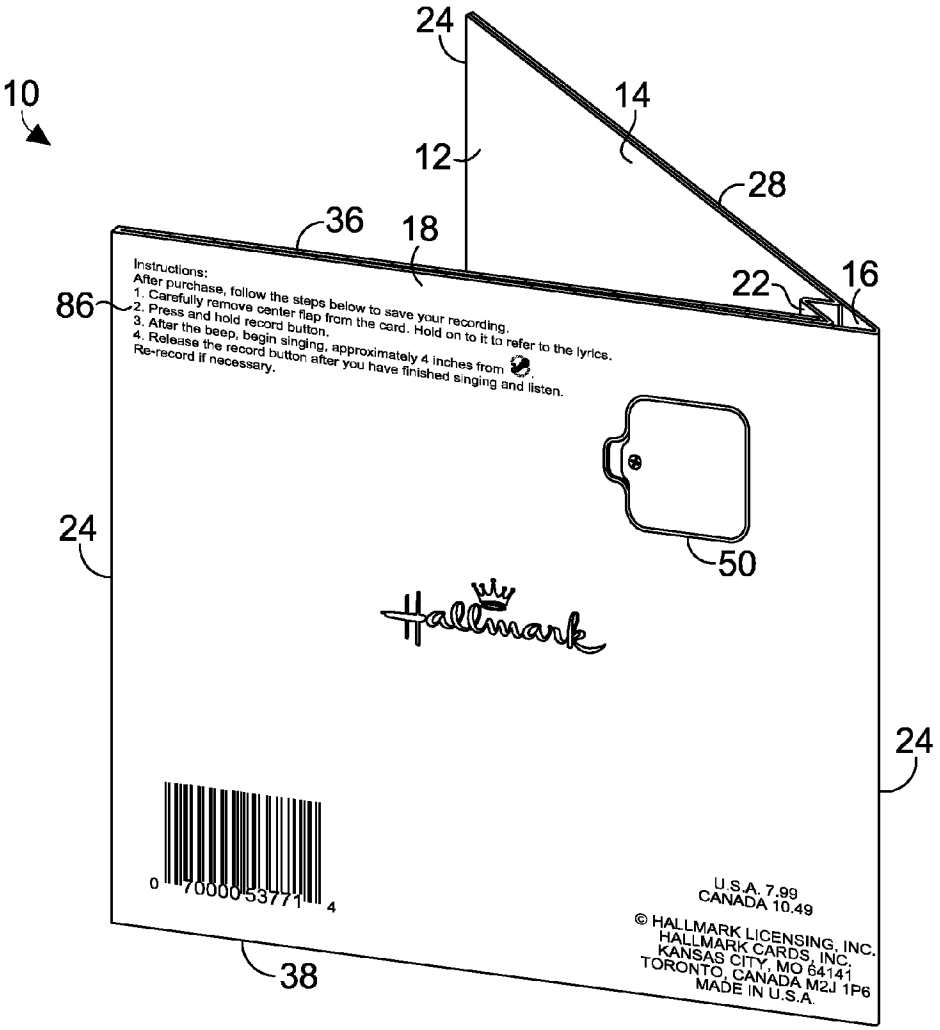

With reference now to FIG. 5, the rear view of the greeting card 10 is illustrated. In the illustrated embodiment, the power supply 50 is accessible through the back panel 18 of the greeting card 10. By providing such access, the purchaser of the greeting card 10 may easily replace the battery 52 of the audio device 48 that is concealed within the second pocket 42. A non-replaceable battery may be used instead. Also shown on the back panel 18 of the greeting card 10 is an instruction area 86. This instruction area 86 may be used to provide additional instructions for recording a karaoke-style recording on the audio device 48, for subsequent playback upon opening the greeting card 10. As will be understood, the printed instructions in the instruction area 86 may appear on any portion of the card body 12, though preferably on the back panel 18.

When appearing in a store for sale, the greeting card 10 appears generally as illustrated in FIG. 1. In this condition (i.e., where the trial mode panel 26 is still coupled with the card body 12), the greeting card 10 is in its trial mode. In one embodiment of the trial mode, upon opening of the greeting card 10 as illustrated in FIG. 1, a first prerecorded and preferably permanent recording is played followed by a second and third prerecorded and permanent recordings. In this embodiment, the first recording is an audio message containing spoken instructions regarding how to record a karaoke-style song onto the greeting card 10. An example of a possible first message would be, "Hi There! This is a karaoke card. Press the button to begin your recording." Once the first recording is played, the audio device 48 waits for further user input.

In this embodiment, the first recording is followed by the user depressing the record button 80, which initiates the playing of the second recording. In the illustrated embodiment, a removable record label 44 is provided to visibly indicate the position of the record button 80 that is concealed in the second pocket 42 between the interior back cover panel 20 and the back panel 18. A user may choose to pinch the record button 80 between their thumb and a finger to initiate the recording session.

In this embodiment, the second recording is second set of instructions. An example of a possible second recording would be, "Listen to the intro music. When you hear the beep, begin singing." Immediately following the second recording, in this embodiment, the audio device 48 begins playing a third audio recording. The third recording is an introductory portion of the karaoke song, followed by a "beep" noise, or other audible indicator, and finally concluding with the karaoke song. As will be understood, the third recording may actually be separated into three, separate, permanently prerecorded audio recordings, such that a separate audio recording is played for each of the introduction, the "beep" noise, and the karaoke song. Alternatively, the third recording may be two separate files, with the entirety of the music in one file and the "beep" noise in a separate file that is only played in the trial mode. While the karaoke song is being played out of the speaker 54, and the user continues to depress the record button 80, the audio device 48 is recording the user's singing of the lyrics into the microphone 82. As previously discussed, the trial mode panel 26 may also be provided with instructions similar, to those in the first and second recordings and the instruction area to inform the user of the recording process, as well as with the lyrics the user is to sing along with the karaoke-style song being played.

Upon completion of recording the user's vocals or audio, the user releases the record button 80. At this point, the audio device 48 automatically initiates playback of the karaoke-style recording so that the user may hear their recording. During playback, the audio device 48 simultaneously plays both the user-recorded karaoke-style recording (i.e., their vocals) and the prerecorded audio recording (i.e., the music or instrumental). In other words, in one embodiment, the final portion of the third recording (i.e. the portion of the prerecorded karaoke style song after the "Beep" noise) is played together with the user's recording of the song. In an alternate embodiment, the song may have a natural introductory portion that is instrumental only. In such case the entire song may be played without the "beep" noise and the two file version of the third recording could be used.

Once the karaoke-style recording has been played, the audio device 48 waits for subsequent user interaction. The trial mode does not provide a way for the user-recorded karaoke-style recording to be played a second time (with the possible exception of switching the card 10 from the trial mode to the use mode, as discussed below). This prevents a situation where a first person in a store records an inappropriate message on the greeting card 10 and leaves it on the shelf to be subsequently played back to a second unsuspecting person at a later time upon opening the card. In this regard, upon closing the card 10, when it is in its trial mode, the audio device 48 reverts to its default procedures and subsequent opening of the card 10 results in playing of the instruction recordings, including the prompts to begin a karaoke-style recording session.

Once a person purchases the greeting card 10, they may switch the greeting card 10 from the trial mode to the use mode. This is done by tearing off and/or removing the trial mode panel 26 from the greeting card 10. This breaks the path 64, as discussed above. Once the greeting card 10 has been put in the use mode, the audio device 48 permits repeated playback of the user-recorded karaoke-style recording upon activation of the audio device 48 by the second or slide switch 68 upon opening of the card 10.

If the user desires to re-record the karaoke-style song prior to sending the card to the intended recipient, the user simply presses the record button 80 again to initiate another record session, thereby recording a new karaoke-style song over the old song. Once the user is satisfied with the message, the user may remove the record label 44 and send the greeting card 10 to the intended recipient. Removal of the label 44 is not necessary; however, removal of the label 44 helps avoid the recipient accidentally recording over the message originally recorded and sent to them by the card sender. Similarly, the audio device 48 is configured to ignore activation of the record button 80 when the second switch 68 is in its open position (i.e., when the greeting card 10 is closed). This also prevents accidental recording over the intended song should the record button be pressed during the mailing process. It should be noted that, in the use mode, the first recording or the first instruction recording is not played initially upon opening of the greeting card 10. Instead, the user-recorded karaoke-style song is played simultaneously with the permanently prerecorded karaoke song either immediately or after a short delay upon opening of the card 10.

Many variations can be made to the illustrated embodiment and/or discussed embodiments of the present invention without departing from the scope of the present invention. Such modifications are within the scope of the present invention. For example, the positions of the switches 80, 68, and 60 can be inverted and the types of switches could be changed. For example, while the tear switch 60 presents a closed circuit in the trial mode and an open mode in the use mode, this could be switched such that removal of the trial mode panel 26 closes the third switch 60. Alternatively, different types of "switches" could be used as would be understood by one of ordinary skill in the art. The term "switches" is used in its broadest sense. Another possible modification would be replacing the slide switch 68 with a light detection mechanism such that opening of the card 10 is recognized by a change in light, thereby sending a signal to the audio device 48 to initiate a playback sequence. Further, while the user-recorded message is played simultaneously with the pre-recorded/non-user recorded recording in one of the embodiments discussed above, it is within the scope of the present invention for the user-recorded message to be played before, during and/or after the pre-recorded recording. In another embodiment, a second user recording session could be employed to let the user provide a spoken dedication that would be played without background music either before (as an introduction) or after the combined playback of the karaoke song. Other modifications would be within the scope of the present invention.

Figure 6:
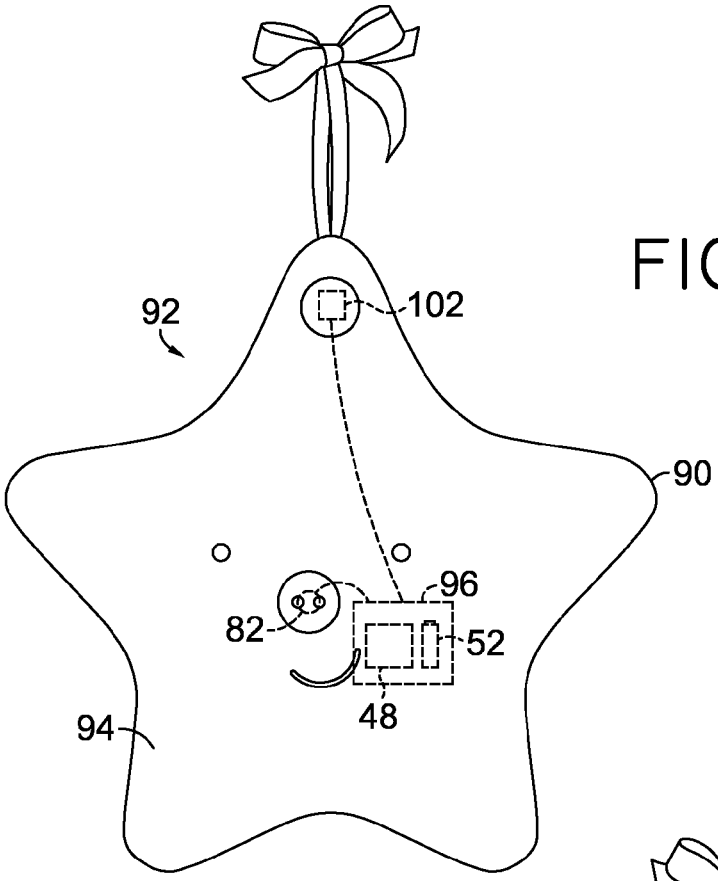
Figure 7:
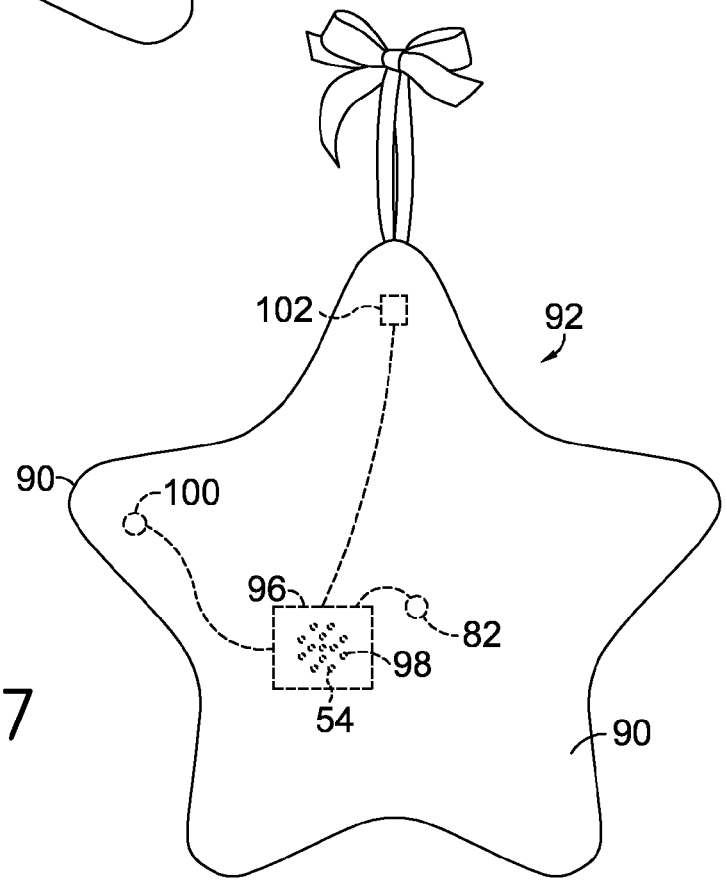

Further, elements of the present invention may be useful in other embodiments. For example, while the karaoke record feature with simultaneous dual playback has been disclosed in a greeting card, the entire electrical components/system or audio recording and playback device 48 could be incorporated in other products, e.g., plush toys, ornaments, etc. In a plush toy embodiment, an audio recording and playback device 48 may be incorporated into a body 90 of a plush toy 92. To overcome the problem of recording the background music during the user recording session, the solution of physically separating the microphone 82 from the speaker 54 can also be implemented. For example, the microphone 82 may be placed in one location, such as near the front surface 94 of the plush toy 92 of FIG. 6, and the speaker 54 could then be spaced apart in another location in the body 90 to minimize pick up of the prerecorded audio recording by the microphone 82 during the user recording session. In the embodiment illustrated in FIGS. 6 and 7, for example, the speaker 54 and other components of the audio device 48 are positioned in a housing 96. The housing 96 has speaker holes 98 therein to direct sound out of the housing 96. The speaker holes 98 can be on a side of the housing 96 that faces away from the front surface 94 of the plush toy 92, thereby directing the sound of the prerecorded audio away from the microphone 82. A record switch/button 100 and a play switch/button 102 may be positioned at different locations inside the body 90 of the plush toy 92.

The plush toy 92 then functions much the same way as the greeting card 10. The purchaser presses the record button 100 to initiate a recording session and sings the lyrics that accompany the prerecorded music file that is being played through the speaker 54. In this embodiment, since the plush toy 92 is a star, the song that is played might be Twinkle, Twinkle, Little Star and the purchaser can record themselves singing the song. Their recorded vocals are then played back simultaneously with a replaying of the prerecorded instrumental music file when the recipient of the plush toy 92 presses the play button 102.

Figure 8:
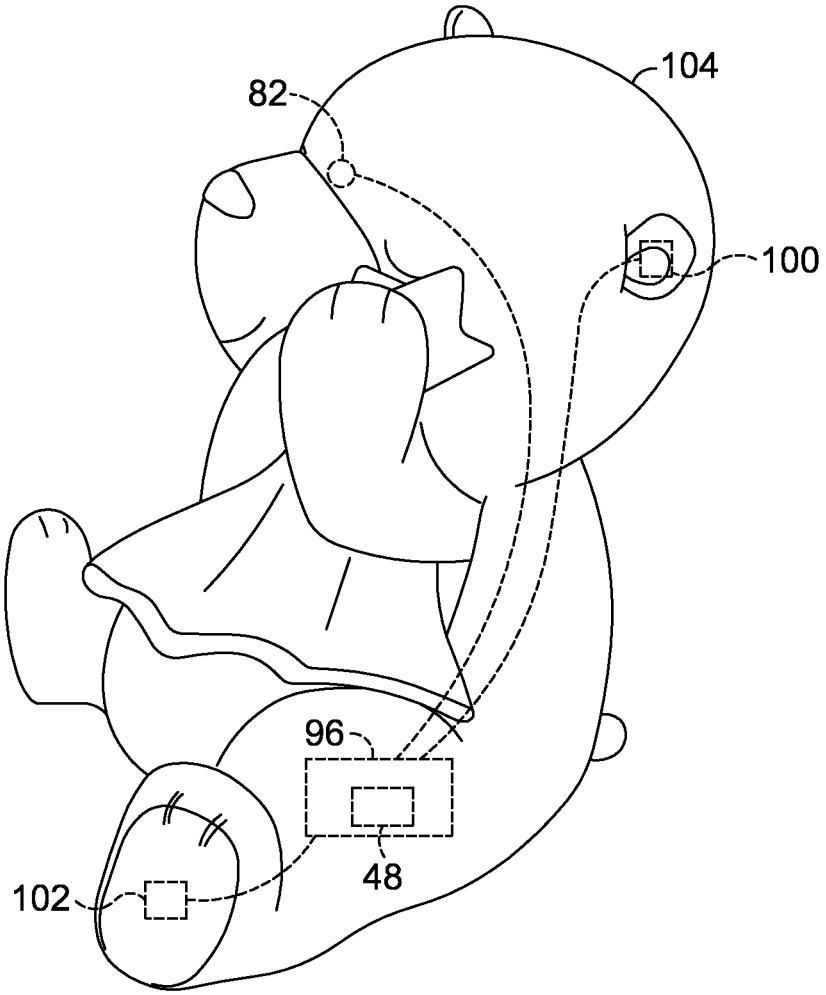

FIG. 8 illustrates another possible implementation of the karaoke record feature with simultaneous dual playback in a plush embodiment. Here, a plush toy 104 takes the form of an animal, such as a bear. The microphone 82 is positioned near a nose of the bear and the housing 96 has been positioned near a bottom of the body of the bear. The positioning of the microphone 82 near the nose allows one to "talk" or "sing" to the animal's face. The positioning of the speaker 54 near the bottom of the body allows the main trunk of the body to still be soft and squeezable and physically separates the speaker 54 from the microphone 82. Alternatively, the microphone could be placed in a distal end of an appendage of a plush toy and the speaker could be placed in an opposite appendage. Additionally, the audio device 48 could be provided with additional features, such as the ability to provide looping or multiple playbacks of the user recorded message. Such a feature can be activated by, for example, the user holding the play button for an extended time period (e.g., four seconds). This would provide for automatic multiple repeat playings of the user recorded message and/or the simultaneous karaoke playback in a row without the need for multiple activations of the play button 102.

Figure 9:
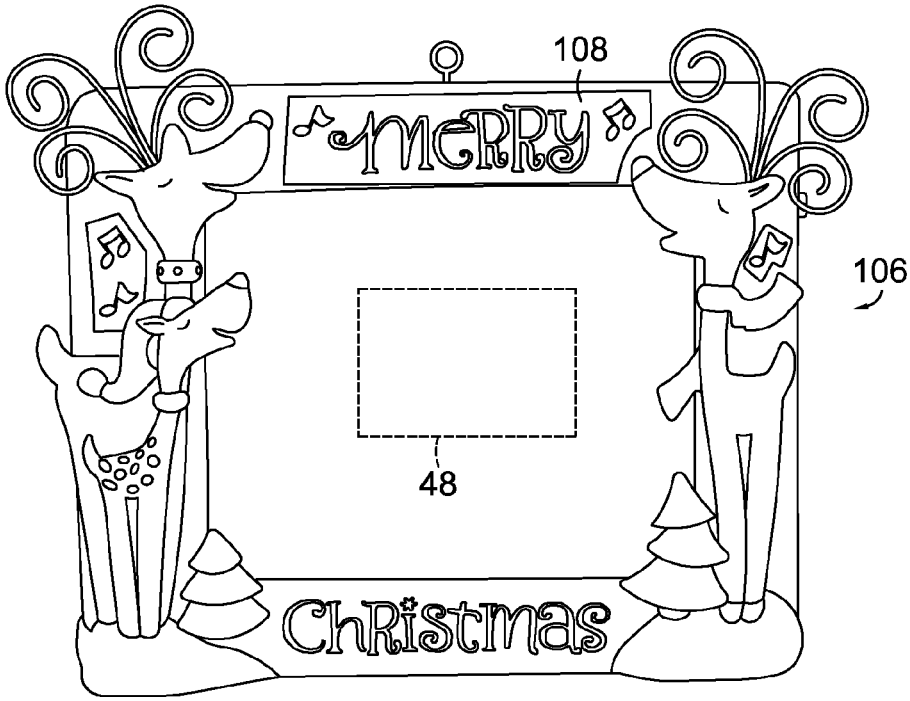
Figure 10:
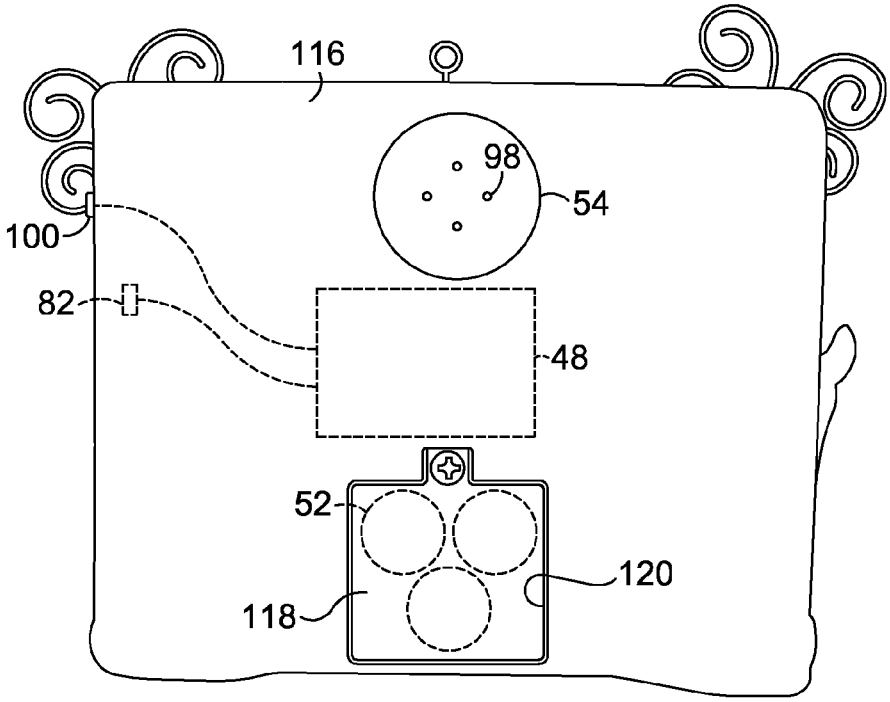
Figure 11:
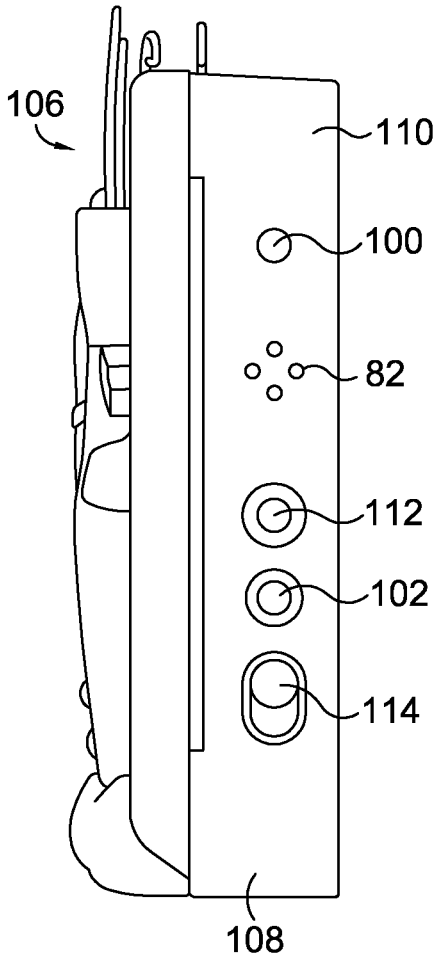

Similar spaced apart positioning of the microphone 82 and the speaker 54 could also occur in other products into which one incorporates the karaoke record and simultaneous playback feature of the present invention. For example, FIGS. 9-11 illustrate an embodiment of the present invention where the karaoke record feature with simultaneous dual playback has been incorporated in an ornament embodiment.

An ornament, such as Christmas ornament 106, has a body 108. In this embodiment, the body 108 takes the form of a picture frame. The audio recording and playback device 48 is then positioned in the body 108. As illustrated in FIG. 11, the play button 102, the microphone 82, and the record button 100 are all positioned along or just behind a side, such as a right side 110, of the body 108. An LED 112 may also be provided on the right side 110 to provide a visual indication that a recording session is occurring when the record button 100 is pressed. Additionally, an archive or lock/unlock switch 114 may be provided to prevent accidental recording over a previously user recorded audio file. The archive or lock/unlock feature may be applied to other embodiments of the present invention.

To accomplish the physical spacing of the microphone 82 from the speaker 54, the speaker can be positioned near a rear face 116 of the body 108 adjacent speaker holes 98. This way, the audio from the playing of the prerecorded music projects rearwardly away from the ornament 106 while the user sings to the side 110 of the ornament 106, thereby minimizing the amount of the prerecorded music being recorded during a user recording session. Other spaced apart locations of the microphone 82 and speaker 54 within the ornament are within the scope of the present invention. A battery cover 118 provides the user with access to a battery compartment 120, such that drained batteries may be replaced to allow for continued playback of a user recorded audio message.

From the foregoing it will be seen that this invention is one well adapted to attain all ends and objects hereinabove set forth together with the other advantages which are obvious and which are inherent to the method and apparatus. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. An audio greeting card comprising:

a card body having a plurality of panels; and an audio recording and playback device coupled with the card body, the device having a microphone, a speaker, a power source, a first switch for initiating an audio recording session, wherein at least one non-user recorded, permanently prerecorded audio recording is played by the audio device while user-generated audio is recorded during the audio recording session and stored as user-recorded audio, and a second switch for initiating an audio playback session, wherein the audio device simultaneously plays back the user-recorded audio and the prerecorded audio recording during the audio playback session.

2. The greeting card of claim 1, wherein the microphone of the audio device is coupled with one of the plurality of panels, wherein the speaker of the audio device is coupled with another one of the plurality of panels, wherein the microphone is physically spaced apart from the speaker.

3. The greeting card of claim 1, wherein the second switch is activated by movement of two of the panels away from each other.

4. The greeting card of claim 1, wherein the device includes at least two non-user recorded, permanently prerecorded audio recordings stored therein, wherein one of the recordings includes audible instructions regarding operation of the audio device, wherein the recording with instructions is played upon activation of the first switch when initiating the audio recording session.

5. The greeting card of claim 4, wherein user-recorded audio is recorded subsequent to playback of the recording with instructions.

6. The greeting card of claim 1, wherein the battery of the audio device is removable through a panel of the card body.

7. An audio greeting card comprising:

a card body having first, second, third and fourth panels; and an audio recording and playback device coupled with the card body, the audio device having a microphone, a speaker, a battery, at least one non-user recorded, permanently prerecorded audio recording stored therein, a first switch for initiating an audio recording session, wherein user-generated audio is recorded during the audio recording session and stored as user-recorded audio, wherein the prerecorded audio recording is played while the user-generated audio is recorded, and a second switch, wherein the audio device has a trial mode and a use mode, wherein activation of the second switch does not initiate simultaneous playback of the user-recorded audio and the at least one prerecorded audio recording in the trial mode, and wherein activation of the second switch initiates simultaneous playback of the user-recorded audio and the at least one prerecorded audio recording in the use mode.

8. The greeting card of claim 7, wherein the card body is formed of a single unitary card blank, wherein the panels are defined by folds in the card blank, wherein the first and second panels are separated by a first fold line, wherein the second and third panels are separated by a second fold line, and wherein the third and fourth panels are separated by a third fold line, wherein the first panel is folded over and secured with the second panel, thereby creating a first pocket, wherein the fourth panel is folded over and secured with the third panel, thereby creating a second pocket, and wherein the audio device is positioned within one or more of the first pocket and the second pocket.

9. The greeting card of claim 7, wherein the second panel is pivotable with respect to the third panel between a closed position, where the second panel overlies the third panel, and an open position, wherein movement of the second panel from the closed position to the open position activates the second switch.

10. The greeting card of claim 7, wherein the card body includes a fifth panel.

11. The greeting card of claim 10, wherein the fifth panel includes lyrics which accompany the at least one prerecorded audio recording stored in the audio device.

12. The greeting card of claim 7, wherein the prerecorded audio recording includes audible instructions regarding operation of the audio device, wherein the audio recording with instructions is played upon activation of the second switch when the audio device is in the trial mode, and wherein the recording with instructions is not played upon activation of the second switch when the audio device is in the use mode.

13. The greeting card of claim 12, wherein the user-generated audio is recorded subsequent to playback of the recording with instructions.

14. The greeting card of claim 8, wherein the microphone of the audio device is positioned in one of the first and second pockets and wherein the speaker of the audio device is positioned in the other of the first and second pockets, whereby the microphone is physically spaced apart from the speaker.

15. The greeting card of claim 7, wherein the user-recorded audio is played back automatically upon completion of the audio recording session, wherein the user-recorded audio is prohibited from additional playback when the audio device is in the trial mode, and wherein the user-recorded audio is permitted additional playback when the audio device is in the use mode upon subsequent activation of the second switch.

16. A method of providing a customizable greeting comprising:

providing a greeting card body having an audio recording and playback device coupled therewith, wherein user-generated audio may be recorded on the audio device by a user during an audio recording session and stored as user-recorded audio, wherein a non-user recorded, permanently prerecorded audio recording is played by the audio device while the user-generated audio is recorded, wherein the user-recorded audio and the prerecorded audio recording are played simultaneously during an audio playback session.

17. The method of claim 16, wherein the audio device has a trial mode where user-recorded audio is automatically played back upon conclusion of the audio recording session, wherein additional playback of the user-recorded audio is not permitted in the trial mode, wherein the audio device has a use mode where user-recorded audio is automatically played back upon conclusion of the audio recording session, and wherein additional playback of the user-recorded audio is permitted in the use mode.

18. The method of claim 17, wherein the prerecorded audio recording includes audible instructions that when played inform the user about the device, wherein the audible instructions are played in the trial mode prior to playing the prerecorded audio recording, and wherein the audible instructions are not played in the use mode.

* * * * *